US006220973B1

(12) United States Patent
Hsu

(10) Patent No.: US 6,220,973 B1
(45) Date of Patent: Apr. 24, 2001

(54) MULTIPLE FUNCTION GOLF AUXILIARY TOOL

(75) Inventor: Te-Fu Hsu, Taipei Hsien (TW)

(73) Assignee: I-SO Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/389,096

(22) Filed: Sep. 2, 1999

(51) Int. Cl.[7] ..... A63B 57/00
(52) U.S. Cl. ..... 473/408; 473/406
(58) Field of Search ..... 473/406, 408; D21/793, 794, 795, 918

(56) References Cited

U.S. PATENT DOCUMENTS

D. 353,645 * 12/1994 Robidoux et al. ..... D21/795
D. 423,069 * 4/2000 Hsu ..... D21/793
3,233,802 * 2/1966 Ludwick ..... 473/406
4,151,937 * 5/1979 Jarosh et al. ..... 473/408
4,998,726 * 3/1991 Budnick ..... 473/406
5,393,052 * 2/1995 Kennedy ..... 473/406
5,419,551 * 5/1995 Hoyt et al. ..... 473/406
5,799,853 * 9/1998 Brewster ..... 224/918

* cited by examiner

*Primary Examiner*—Steven Wong
(74) *Attorney, Agent, or Firm*—Bacon & Thomas

(57) ABSTRACT

A multiple functional golf auxiliary tool comprises a receiving housing, one or more ball emitting posts, a grass removing fork, one or two sets of cleaning brushes, a counting disk, and a mark block. Two sides of the receiving housings are installed with a ball emitting post and a grass removing fork, respectively. Another end of the receiving housing is installed with cleaning brushes, a counting disk, a mark block, and other auxiliary tools sequentially. When a golf moves, by the aforesaid auxiliary tools, the function of positioning a ball at a predetermined position, smoothing the grass, removing dirt on the beating surface, recording beating number, marking the grounding point of the ball, and others. Therefore, all the auxiliary tools are combined integrally and multiple functions are concentrated in one tool. Moreover, the present invention may be combined with a key coil for being carried by the user himself (or herself).

10 Claims, 5 Drawing Sheets

MULTIPLE FUNCTION GOLF AUXILIARY TOOL

FIELD OF THE INVENTION

The present invention relates to a multiple functional golf auxiliary tool comprising some auxiliary devices, such as a receiving housing, one or more ball emitting posts, a grass removing fork, one or two sets of cleaning brushes, a counting disk, and a mark block, which are installed at a receiving housing. Thus, the present invention is compact and can be carried by user himself (or herself).

BACKGROUND OF THE INVENTION

Some auxiliary devices are used in golf for meeting different requirements in sporting. For example, as a golf ball is beat, the post for emitting ball must be inserted in the grass for positioning the golf ball. When the grass are not smooth so as to affect the traveling of the ball, a grass removing fork is necessary to smooth the grass. When dirt is accumulated on the surface of a rod, a cleaning brush is needed to brush the surface. A counting disk is necessary for recording the rod number. Besides, a mark block serves to mark the grounding point of the ball. All aforesaid devices are necessary in golf sport. Although these devices are compact, they are not integrated and thus are inconvenient for carrying and storage.

SUMMARY OF THE INVENTION

Accordingly, the primary object of the present invention is to provide a multiple functional golf auxiliary tool comprising a receiving housing, one or more ball emitting posts, a grass removing fork, one or two sets of cleaning brushes, a counting disk, and a mark block. Two sides of the receiving housings are installed with a ball emitting post and a grass removing fork, respectively. Another end of the receiving housing is installed with cleaning brushes, a counting disk, a mark block, and other auxiliary tools, sequentially. When a golf moves, by the aforesaid auxiliary tools, the function of positioning a ball at a predetermined position, smoothing the grass, removing dirt on the beating surface, recording beating number, marking the grounding point of the ball, and others. Therefore, all the auxiliary tools are combined integrally and multiple functions are concentrated in one tool. Moreover, the present invention may be combined with a key coil for being carried by the user himself (or herself).

Another object of the present invention is to provide a multiple functional golf auxiliary tool, wherein a plate or a mark can be adhered to a selected position at two lateral surfaces of the receiving housing for marking name of the user or the product.

The various objects and advantages of the present invention will be more readily understood from the following detailed description when read in conjunction with the appended drawing.

DETAILED DESCRIPTION OF THE PREFERRED EMBODIMENTS

Figure 2:
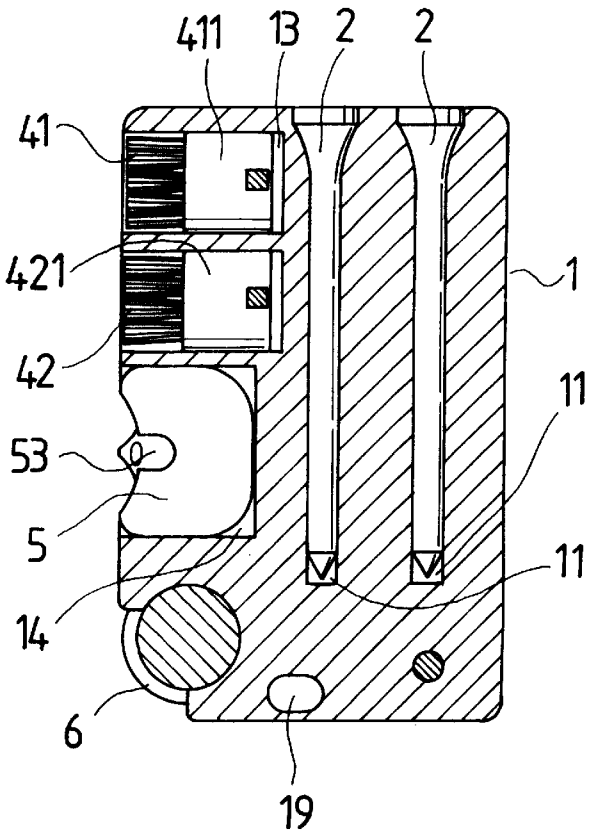
FIG. 2 is a cross sectional view of the present invention.
Figure 1:
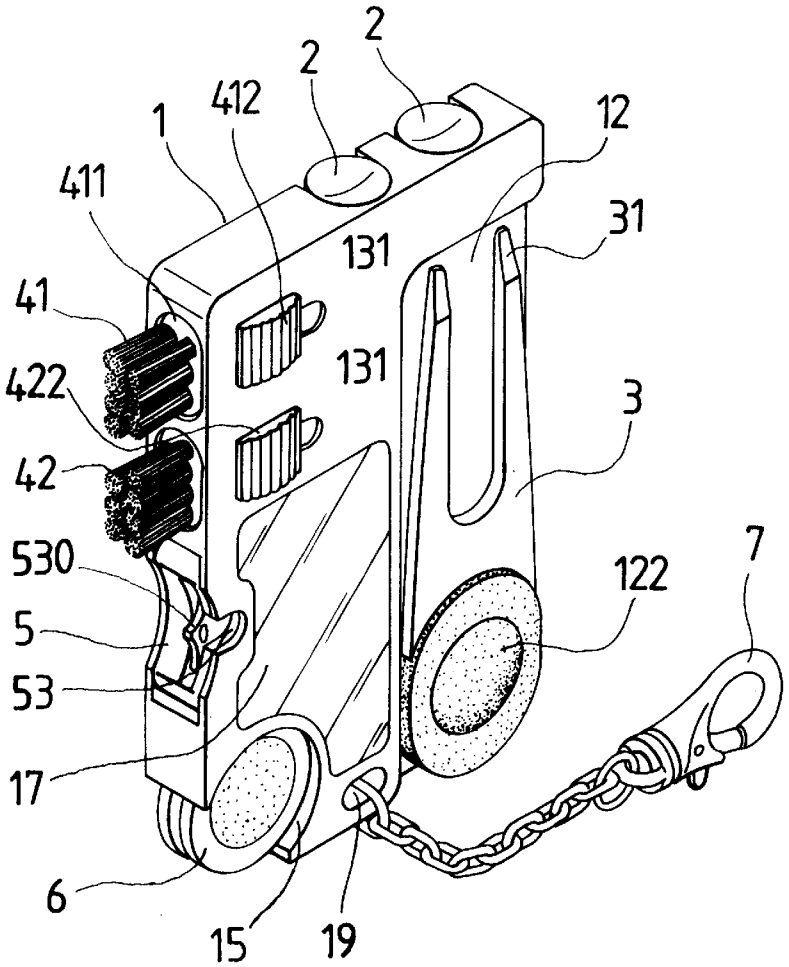
FIG. 1 is a perspective view of the present invention.
Figure 3:
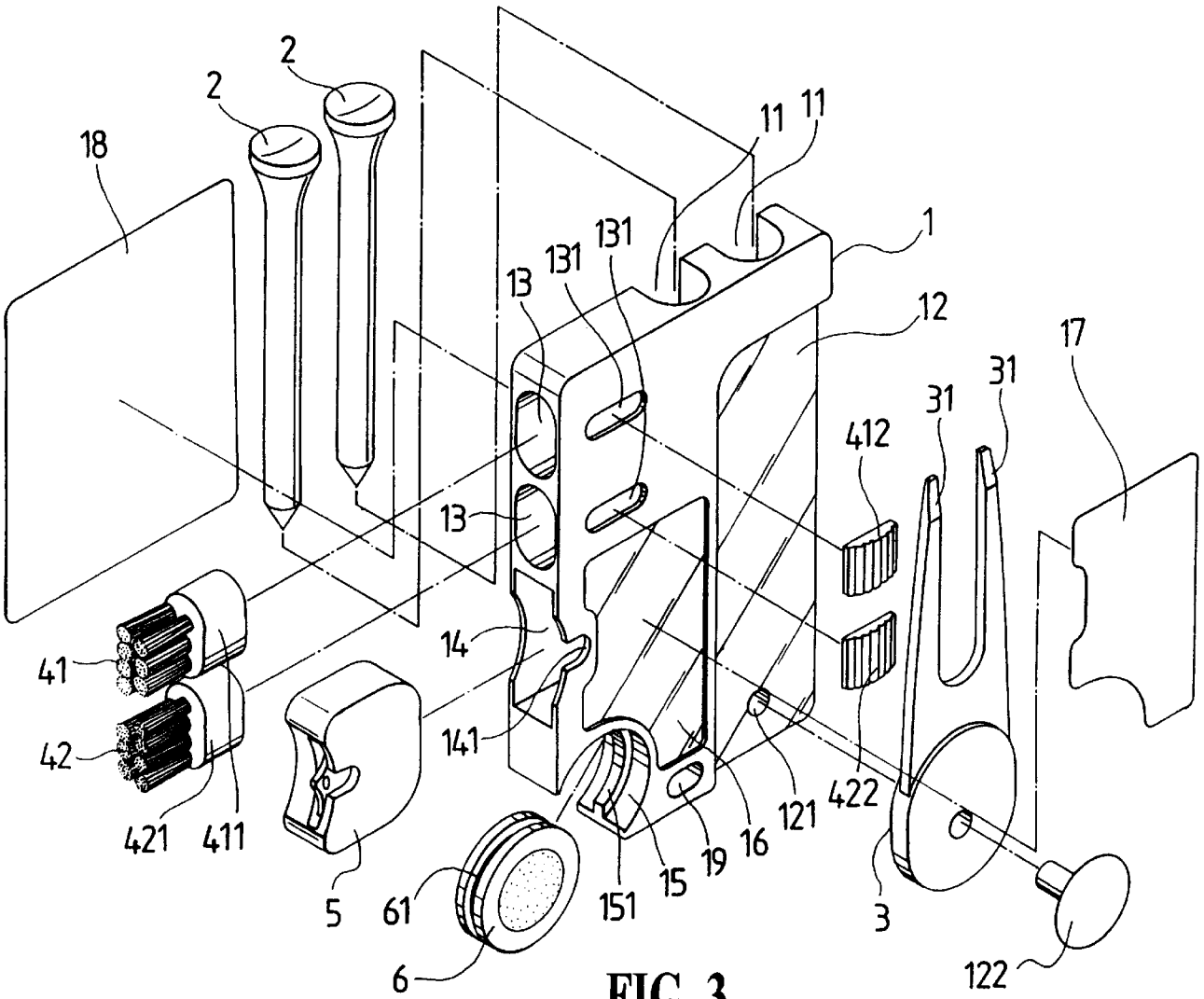
FIG. 3 is an exploded perspective view of the present invention.
Figure 6:
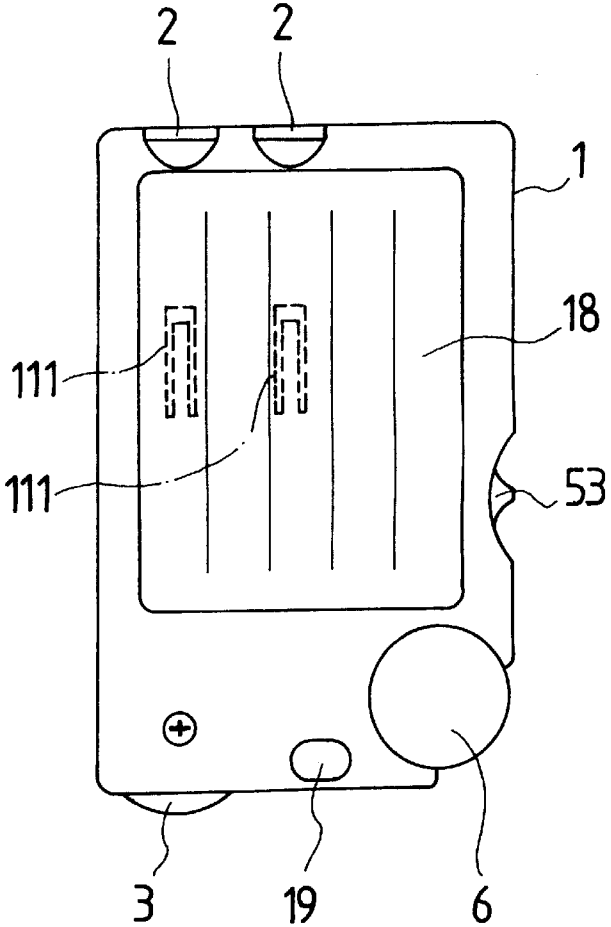
FIG. 6 is a rear view of the present invention.
Figure 5:
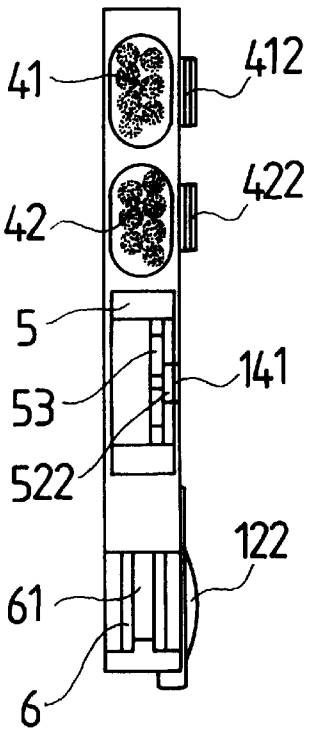
FIG. 5 is a lateral view of the present invention.
Figure 4:
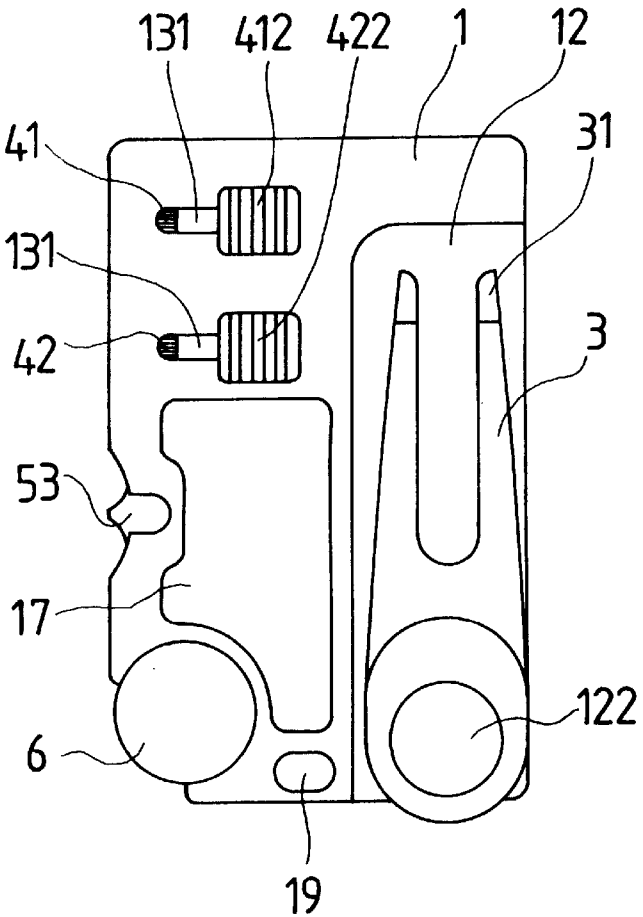
FIG. 4 is a front view of the present invention.

With reference to FIGS. 1~6, the multiple functional golf auxiliary tool of the present invention includes a receiving housing 1, one or more ball emitting posts 2, a grass removing fork 2, one or two sets of cleaning brushes 41 and 42, a counting disk 5, and a mark block 6.

At least one inserting groove 11 is installed at one lateral side of the receiving housing body 1 for being inserted by the ball emitting posts 2. A groove 12 is installed at the another lateral side. An aperture 121 is installed at the place of the groove 12 so that the aperture 121 is adapted to be penetrated by a locking piece 11 and thus to pass through the grass removing fork 3. In general, the grass removing fork 3 is received within the groove 12. As the grass removing fork is turned outwards, then it may be used. Moreover, at least one slot 13 is formed at the upper portion of the lateral side of the receiving housing 1. A lateral hole 131 is formed at the lateral wall of the slot 13. The slot 13 can receive one or two sets of cleaning brushes 41 and 42 so that the supporting seats 411 and 421 of the cleaning brushes 41 and 42 can be combined with push buttons 412, 422 at the outer end of the lateral hole 1131 for controlling the using as being pushed outwards or storage as being pulled inwards. Another, a receiving groove 14 is formed at the lower portion of the slot 13 of the receiving housing 1 so to provide a counting disk 5 to be active or fixed. Besides, the lower end of the receiving groove 44 of the receiving housing 1 is formed with a cambered notch 15. A cambered track 151 is installed at the inner wall of the notch so that the cambered notch 15 can be embedded by a round mark block 6.

Figure 7:
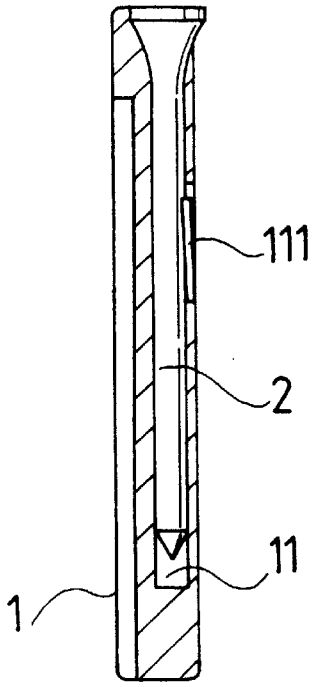
FIG. 7 is a partial cross sectional view schematically showing the inserting groove of the receiving housing and an embedded ball emitting post of the present invention.
Figure 8:
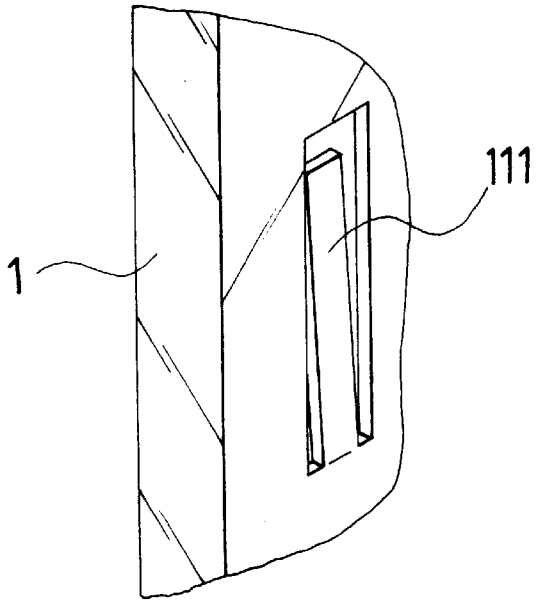
FIG. 8 is a partial perspective view schematically showing an elastic piece being punched at the lateral wall of the inserting groove at the receiving housing of the present invention.

Referring to FIGS. 7 and 8, an elastic piece capable to inwards resist against a wall is punched from (or locked to) the lateral wall of inserting groove 11 of the receiving housing 1. Thus, after the ball emitting posts 2 are inserted, fixing and positioning effects are achieved. The depth of the aforesaid inserting groove 11 is correspondent to the length of ball emitting post 2. Thus, the ball emitting post 2 can be embedded into the groove completely.

In the cambered notch 11 of the receiving housing 1, the length of the notch must slightly smaller than the diameter of the mark block 6. A round trench 61 is installed at the wall of the mark block 6. Therefore, a buckling effect is formed between the cambered notch 15 of the round trench 61 and the cambered track 151. Since the length of the notch is smaller than the round diameter of the mark block 6, thus the mark block 6 can be embedded into the cambered notch 15 exactly. Thus, the dropping out event is prevented effectively.

Figure 10:
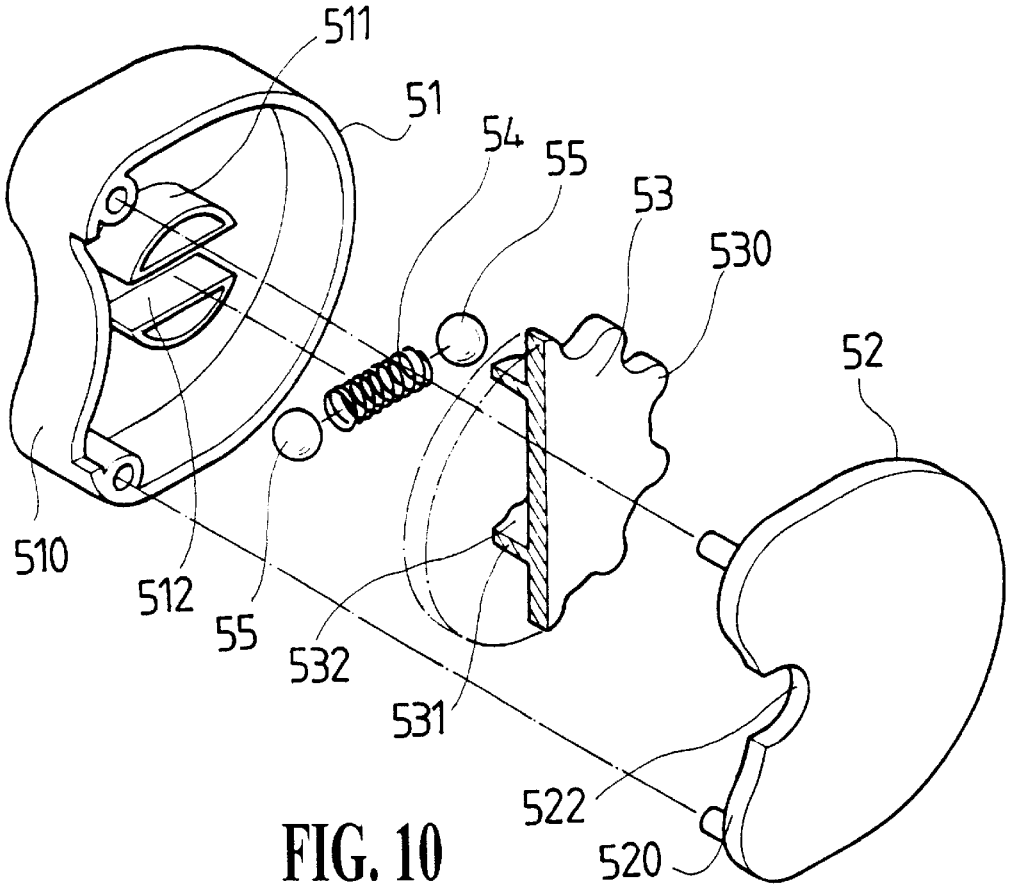
FIG. 10 is an exploded perspective view of the counting disk in the present invention.
Figure 9:
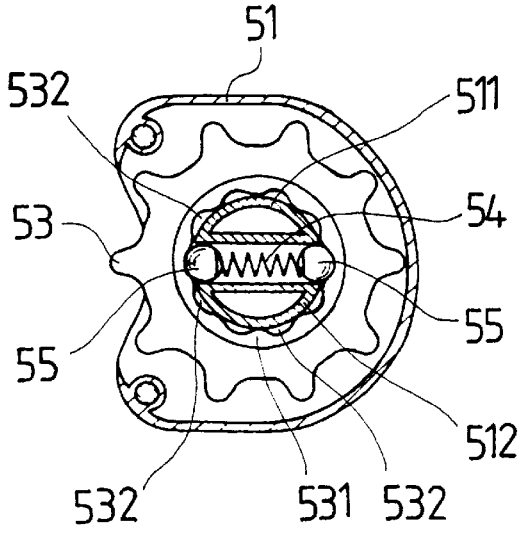
FIG. 9 is an assembled cross sectional view showing the counting disk of the present invention.
Figure 11:
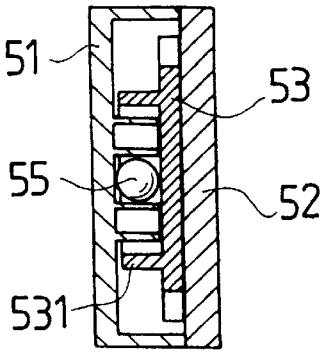
FIG. 11 is an assembled cross sectional view showing the counting disk in the present invention.

In the receiving groove 44 of the receiving housing 1, two lateral walls are concave properly. A smaller concave surface 141 is formed at the wall of the detecting surface. Thus, after the counting disk 5 is received, the moving and detecting actions can be performed conveniently. FIGS. 9 to 11 shows the structure of the counting disk 5. The counting disk 5 includes two lateral covers 51 and 52, a movable piece 53, a spring 54, and two steel balls 55.

The two lateral covers 51 and 52 can be combined for formed as a hollow casing. Each side of the two lateral covers 51 and 52 has a cambered concave wall 510, 520, respectively. In one of the lateral covers, the inner wall thereof is installed with two opposite semi-spherical rings 511 and 512. A notch 522 is installed at the concave wall 520 of another lateral cover 52.

The movable piece 52 is an acute teeth piece, and the surface of each tooth is printed with numbers 1 to 10 (not shown) for counting. A ring 531 is installed at the lateral surface thereof. A plurality of grooves 532 are installed at the inner wall of the ring 531. The ring 531 may be engaged with the two semi-spherical rings 511, and 512.

Each end of the spring 54 is resisted against by a steel ball 55 for being embedded into the ring 531 of the movable piece 52. The two steel balls 55 are installed in the grooves 532 with respect to the two ends of the ring 531. When the movable piece 53 and the two semi-spherical rings 511 and 512 are engaged, the spring 54 is exactly embedded into the gap of the two semi-spherical rings 511 and 512. Therefore, when the movable piece 53 rotates and moves, by the ejecting and movement of the two steel balls 55 and the groove 532, a slight movement is generated and a slight voice of di-da is emits. Since the teeth 530 of the movable piece 53 protrudes from the movable piece 522 of the lateral cover 52 and the notch 522 is respective to the wall of the receiving groove 14 of the receiving housing 1, the number of the teeth 530 is clearly displayed so that the user may recorded the beating number in each hole.

In the two sets cleaning brushes 41, 42, one set has soft hairs (such as made of plastics), while another set has hard hairs (such as made of copper or steel material) for cleaning wood rod or iron rod.

In the aforesaid grass removing fork 3, the fork end is cut as a sharp post 31 for removing dirt on the golf rod.

Moreover, according to the present invention, a proper concave surface is formed between the groove 12 and the receiving groove 14 for being combined by a marking brand 17 of a product. Similarly, at another lateral surface of the receiving housing 1, a larger plate 18 can be appended for marking name, address, or directory number of the user. Besides, a through hole 19 may be formed on a selectable place on the body of the receiving housing I so that it can be adhered to a lock coil 7 for being carried by himself (or herself).

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multiple functional golf auxiliary tool comprising a receiving housing, one or more golf tees, a divot removing fork, one or two sets of cleaning brushes, a counting disk, and a ball marker, characterized in that:

the receiving housing comprises a receiving body with at least a first groove in a first lateral side of the body, said groove containing at least one golf tee, a second groove in a second lateral side of said housing which contains a divot removing fork within the groove at a selected position;

at least one slot at the upper portion of a third lateral side of the receiving housing; the slot retaining one or two sets of cleaning brushes;

a third receiving groove for a counting disk formed at the lower portion of the slot of the receiving housing and fitted with a counting disk;

the lower end of the third receiving groove of the receiving housing contains a cambered notch with two ends, the length between the two ends of the notch is slightly smaller then the diameter of a ball marker so that the cambered notch is embedded by a circular ball marker; and wherein the counting disk includes first and second lateral covers, a movable piece, a cylindrical spring with two ends, and two steel balls;

the first and second lateral covers are combined to form a hollow casing, each side of the first and second lateral covers has a cambered concave wall and the inner wall of the first lateral cover contains two opposed semi-spherical rings;

the concave wall of the second lateral cover contains a notch; and wherein the movable piece is circular in shape with acute teeth on its outer periphery, the lateral surface of each tooth is printed with sequential numbers for counting and viewing through the notch in the second lateral cover;

the movable piece has an inner ring structure containing a plurality of spaced grooves which engage the two semi-spherical rings, each of two ends of the spring compress a steel ball into a corresponding groove in the inner ring structure of the ring and when the movable piece rotates on the two spherical rings each ball moves over the grooves and by the force of the spring engages the corresponding groove in the counting process, a slight noise is emitted; and the number on the teeth is clearly displayed through the notch.

2. The multiple functional golf auxiliary tool as claimed in claim 1, wherein a lateral hole is formed in the second lateral wall of the slot, the slot receives cleaning brushes so that the supporting seat of the cleaning brushes are combined with push buttons at the outer end of the lateral hole for controlling the use of the cleaning brushes as being pushed outwards or storage of the cleaning brushes as being pulled inwards.

3. The multiple functional golf auxiliary tool as claimed in claim 1, wherein the cambered notch at the lower corner of the receiving housing contains a cambered track at the inner wall of the notch, a round trench is installed at the wall of the ball marker, thereby, the round trenches and the cambered track of the cambered notch are engaged for positioning.

4. The multiple functional golf auxiliary tool as claimed in claim 1, wherein an elastic piece capable of applying inward pressure against the golf tee to fix the tee in place is contained in the second lateral wall of inserting groove of the receiving housing.

5. The multiple functional golf auxiliary tool as claimed in claim 1, wherein the first and second lateral walls have appropriate concave portions; a smaller concave surface is formed at the wall of the detecting surface; after the counting disk is received, so that the moving and detecting actions are performed conveniently.

6. The multiple functional golf auxiliary tool as claimed in claim 1, wherein in which contains two sets of cleaning brushes, the first set having soft hairs, and the second set has hard hairs for cleaning wood rod or iron golf clubs.

7. The multiple functional golf auxiliary tool as claimed in claim 1, wherein the divot removing fork has a sharp end installed at the receiving housing is and cut as a sharp post.

8. The multiple functional golf auxiliary tool as claimed in claim 7 wherein a concave surface is formed between the groove of the receiving housing and the receiving groove for being marked with a product name.

9. The multiple functional golf auxiliary tool as claimed in claim 1, wherein a larger plate is adhered to one selected lateral surface of the receiving housing.

10. The multiple functional golf auxiliary tool as claimed in claim 1, wherein a through hole is installed at the selected position of the body for being hung by a lock coil.

* * * * *